US006278087B1

(12) United States Patent
Willkens et al.

(10) Patent No.: US 6,278,087 B1
(45) Date of Patent: Aug. 21, 2001

(54) CERAMIC IGNITERS AND METHODS FOR USING AND PRODUCING SAME

(75) Inventors: Craig A. Willkens, Sterling, MA (US); James M. Olson, Windham; Scott M. Hamel, Wilton, both of NH (US)

(73) Assignee: Saint-Gobain Industrial Ceramics, Inc., Worcester, MA (US)

( * ) Notice: Subject to any disclaimer, the term of this patent is extended or adjusted under 35 U.S.C. 154(b) by 0 days.

(21) Appl. No.: 09/491,170

(22) Filed: Jan. 25, 2000

(51) Int. Cl.[7] ..... H05B 3/00; F23Q 7/22

(52) U.S. Cl. ..... 219/270; 219/552; 219/540; 219/260

(58) Field of Search ..... 219/270, 260, 219/552, 530, 540, 553; 252/516, 518.1

(56) References Cited

U.S. PATENT DOCUMENTS 3,681,737 * 8/1972 Magnusson et al. ..... 219/260
3,974,106 * 8/1976 Richerson ..... 252/516
5,085,804 * 2/1992 Washburn ..... 219/270
5,786,565 * 7/1998 Willkens et al. ..... 219/260
5,820,789 * 10/1998 Willkens et al. ..... 252/516
5,892,201 * 4/1999 Croucher et al. ..... 219/260
6,002,107 * 12/1999 Willkens et al. ..... 219/270
6,028,292 * 2/2000 Willkens et al. ..... 219/270

* cited by examiner

*Primary Examiner*—John A. Jeffery
(74) *Attorney, Agent, or Firm*—Mike W. Crosby; Peter F. Corless; Edwards & Angell, LLP

(57) ABSTRACT

Ceramic igniters are provided that comprise two cold zones with an interposed hot zone, the hot zone having an electrical path length of from 0.51 cm to about 2 cm. Igniters of the invention can effectively diffuse power density throughout the igniter hot zone region, without producing isolated temperature gradients which can lead to premature igniter degradation and failure. The invention also provides new methods for forming ceramic igniters.

33 Claims, 1 Drawing Sheet

CERAMIC IGNITERS AND METHODS FOR USING AND PRODUCING SAME

BACKGROUND OF THE INVENTION

1. Field of the Invention

The invention relates to ceramic igniters and improved methods for making the igniters.

2. Background

Ceramic materials have enjoyed great success as igniters in gas fired furnaces, stoves, clothes dryers, and other devices that require ignition of gaseous fuel. Ceramic igniter production requires constructing an electrical circuit through a ceramic component, a portion of which is highly resistive and rises in temperature when electrified by a wire lead.

One conventional igniter, the Mini-Igniter™, available from the Norton Igniter Products of Milford, N.H., is designed for 12 volt through 120 volt applications and has a composition comprising aluminum nitride ("AlN"), molybdenum disilicide ("$MoSi_2$"), and silicon carbide ("SiC").

U.S. Pat. No. 5,786,565 to Willkens et al. (the "565 patent") discloses highly useful ceramic igniters that comprise a) a pair of electrically conductive portions, each portion having a first end, b) a resistive hot zone disposed between and in electrical connection with each of the first ends of the electrically conductive portions, the hot zone having an electrical path length of less than 0.5 cm, and c) an electrically non-conductive heat sink material contacting the hot zone.

A variety of performance properties are required of ceramic igniter systems, including high speed (low time to heat from room temperature to design temperature) and sufficient robustness to operate for extended periods without replacement. Many conventional igniters, however, do not consistently meet such requirements. It thus would be desirable to have new ceramic igniter systems.

SUMMARY OF THE INVENTION

We have now discovered new, highly useful ceramic igniters that can exhibit exceptional performance properties, including long operational lives.

It was surprisingly found that the ceramic igniters disclosed in the above discussed '565 patent sometimes fail due to "burnout" of the igniter hot zone region. As mentioned above, the '565 patent discloses an igniter having a relatively short hot zone electrical path length of less than 0.5 cm. Without being bound by theory, it is believed that during operation of such an igniter, the power density generated at high line voltage gives rise to a high temperature gradient. This high temperature gradient is believed to result in accelerated oxidation of a localized region of the igniter hot zone, which may result in premature failure of the device.

In contrast, igniters of the invention can provide a more diffuse power density throughout a hot zone region, thereby avoiding undesirable temperature gradients in isolated hot zone areas while providing tip heating.

More specifically, in one aspect of the invention, ceramic igniters are provided that comprise: a) a pair of electrically conductive portions, each portion having a first end; and b) a resistive hot zone disposed between and in electrical connection with each of the first ends of the electrically conductive portions, wherein the hot zone has an electrical path length of between 0.51 cm and 2 cm.

Preferred igniters of the invention have a hot zone electrical path length of between 0.6 cm and 1.5 cm, more preferably from 0.6 cm to about 1.2 cm, still more preferably from about 0.7 cm to 0.9 cm. As used herein, the term "electrical path length" designates the length of the shortest path taken by an electrical current through the igniter hot zone region when an electrical potential is applied to the conductive ends of the igniter.

It is believed that such hot zone lengths can effectively diffuse power density throughout the hot zone region, without producing isolated temperature gradients which can lead to premature igniter degradation and failure. Moreover, the electrical path length limits (up to about 2 cm) result in effective heating and short times to ignition temperature, without the need for excessive power input into the system.

We also have found that preferably the hot zone region has a non-linear geometry, e.g. a substantially U-shaped design, whereby the hot zone extends without interruption across the top igniter width and then along a portion of each side of the igniter length. It is believed such non-linear designs can more effectively diffuse or reduce the power density within the hot zone region, relative to a comparable system having a linear hot zone.

Igniters of the invention preferably also have an electrically non-conductive portion (heat sink) in contact with the hot zone region. In particular, the non-conductive portion is preferably interposed or inserted between the electrically conductive portions and in contact with the hot zone region.

We also have found that preferably the bridge height of the hot zone (width of the hot zone in a rectangular igniter, discussed further below) is preferably at least about 0.05 cm, more preferably at least about 0.06 cm. A hot zone bridge height of from 0.05 cm to 0.4 cm is generally preferred; and a hot zone bridge height of from 0.06 cm to about 0.3 cm is more preferred.

Preferably, hot zones of igniters of the invention will contain a sintered composition containing a conductive material and an insulating material, and typically will further contain a semiconductor material. Conductive or cold zone portions of igniters of the invention will contain a sintered composition of similar components, with relatively higher concentrations of conductive material.

Igniters of the invention can be suitably operate over a wide range of voltages, including nominal voltages of 6, 8, 12, 24 and 120.

Further provided arc new methods for producing igniters of the invention, which include manufacture of a plurality of igniters from a single billet material, enabling significantly more efficient igniter production. Preferred methods of the invention for forming a ceramic igniter comprise a) providing an electrically conductive ceramic body that comprises a plurality of affixed igniter elements; b) inserting into each element an electrically non-conductive material; and c) densifying the plurality of igniter elements.

Other aspects of the invention are disclosed infra.

DETAILED DESCRIPTION OF THE INVENTION

As indicated above, the invention provides a sintered ceramic igniter element comprising two cold zones and a hot zone, the hot zone having an electrical path length of from 0.51 cm to about 2 cm. More typically, the electrical path length will be somewhat longer than 0.51 cm, e.g. at least about 0.6 cm, 0.7 cm or 0.8 cm.

Figure 1:
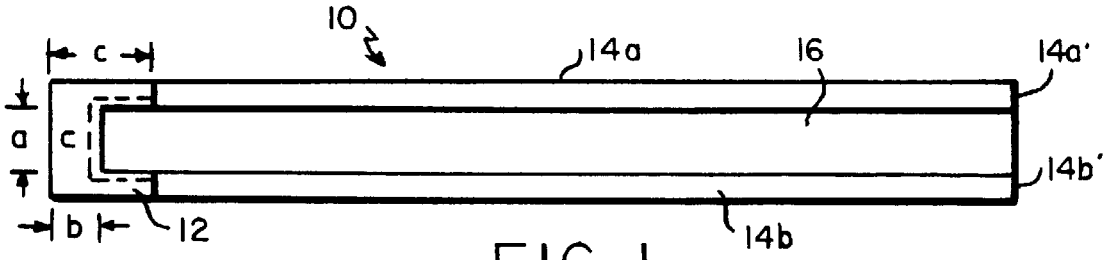
FIG. 1 depicts a preferred igniter of the invention.

FIG. 1 of the drawings depicts a preferred igniter 10 of the invention that includes a hot zone portion 12 in contact with and disposed between cold zones 14*a* and 14*b*. Heat sink 16 is interposed between those cold zones 14*a* and 14*b* and in contact with hot zone 12. Cold zone ends 14*a*' and 14*b*' distal from hot zone 12 are in electrical connection to a power source, typically through use of some type of lead frame mounting.

As shown in FIG. 1, hot zone 12 has a non-linear, substantially U-shaped electrical path length "e" (shown with dotted line to emphasize minimum path) that extends down the length of each side of the igniter. As discussed above, such non-linear hot zone geometries are believed to more effectively diffuse power density throughout the hot zone region and enhance operational life of the igniter.

The dimensions of the hot zone region may suitably vary provided that the overall hot zone electrical path length is within the ranges disclosed herein. In the generally rectangular igniter design depicted in FIG. 1, preferably the hot zone width between the cold zones (depicted as distance "a" in FIG. 1) is sufficient to avoid electrical shorts or other defects. In one preferred system, that distance a is 0.5 cm.

The hot zone bridge height (depicted as distance "b" in FIG. 1) also should be of sufficient size to avoid igniter defects, including excessive localized heating, which can result in igniter degradation and failure as discussed above. As discussed above, preferably the hot zone bridge height is at least about 0.05 cm, more preferably at least about 0.06 cm. A hot zone bridge height of from 0.05 cm to 0.4 cm is generally preferred; a hot zone bridge height of from 0.06 cm to about 0.3 cm is more preferred; and a hot zone bridge height of from 0.06 to 0.035 to 0.040 is particularly preferred. Hot zone bridge heights of 0.035 and 0.040 have been found to be particularly suitable. The term "hot zone bridge height" as used herein is understood to mean the dimension of a hot zone that extends parallel to the length or long dimension of a generally rectangular igniter, as exemplified by dimension b depicted in FIG. 1.

The hot zone "legs" that extend down the length of the igniter will be limited to a size to maintain the overall hot zone electrical path length to within about 2 cm.

The composition components of the hot zone 12, cold zones 14*a* and 14*b*, and heat sink non-conductive region 16 may suitably vary. Suitable compositions for those regions are disclosed in U.S. Pat. No. 5,786,565 to Willkens et al. as well as in U.S. Pat. No. 5,191,508 to Axelson et al., which patents are incorporated herein by reference.

More particularly, the hot zone has a high temperature (i.e. 1350° C.) resistivity of between about 0.01 ohm-cm and about 3.0 ohm-cm and a room temperature resistivity of between about 0.01 ohm-cm and about 3 ohm-cm. Preferred hot zone compositions contain a sintered composition of an electrically insulating material, and a metallic conductor, and preferably further containing a semiconductor material. As used herein, the term electrically insulating material refers to a material having a room temperature resistivity of at least about $10^{10}$ ohm-cm. As used herein, the term metallic conductor or conductive material refers to a material that has a room temperature resistivity of less than about $10^{-2}$ ohm-cm. As used herein, the term semiconductive ceramic (or "semiconductor") is a ceramic having a room temperature resistivity of between about 10 and $10^8$ ohm-cm.

In general, preferred hot zone compositions include (a) between about 50 and about 80 volume percent (vol % or v/o) of an electrically insulating material having a resistivity of at least about $10^{10}$ ohm-cm; (b) between about 5 and about 45 v/o of a semiconductive material having a resistivity of between about 10 and about $10^8$ ohm-cm; and (c) between about 5 and about 25 v/o of a metallic conductor having a resistivity of less than about $10^{-2}$ ohm-cm. Preferably, the hot zone comprises 50–70 v/o electrically insulating ceramic, 10–45 v/o of the semiconductive ceramic, and 6–16 v/o of the conductive material. In certain preferred embodiments, the conductive material is $MoSi_2$, preferably present in an amount of from about 9 to 15 vol %, based on total components of the hot zone composition, more preferably from about 9 to 13 vol %, based on total components of the hot zone composition. For a 24 volt igniter, a particularly preferred molybdenum disilicide concentration is from about 9.2 to 9.5 vol %, based on total components of the hot zone composition.

Suitable electrically insulating material components of hot zone compositions include one or more metal oxides such as aluminum oxide, a nitride such as a aluminum nitride, silicon nitride or boron nitride; a rare earth oxide (e.g., yttria); or a rare earth oxynitride. Aluminum nitride (AlN) and aluminum oxide ($Al_2O_3$) are generally preferred.

Typically, the metallic conductor is selected from the group consisting of molybdenum disilicide, tungsten disilicide, and nitrides such as titanium nitride, and carbides such as titanium carbide. Molybdenum disilicide is generally preferred.

Generally preferred semiconductor materials include carbides, particularly silicon carbide (doped and undoped), and boron carbide. Silicon carbide is generally preferred.

Particularly preferred hot zone compositions of the invention contain aluminum oxide and/or aluminum nitride, molybdenum disilicide and silicon carbide. As mentioned above, in at least certain embodiments, the molybdenum disilicide is present in an amount of from 9 to 12 vol %. For a 24 volt igniter, a particularly preferred molybdenum disilicide concentration is from about 9.2 to 9.5 vol %, based on total components of the hot zone composition.

As discussed above, igniters of the invention typically also contain at least one or more low resistivity cold zone region in electrical connection with the hot zone to allow for attachment of wire leads to the igniter. Typically, a hot zone composition is disposed between two cold zones. Preferably, such cold zone regions are comprised of e.g. AlN and/or $Al_2O_3$ or other insulating material; SiC or other semiconductor material; and $MoSi_2$ or other conductive material. However, cold zone regions will have a significantly higher percentage of the conductive and semiconductive materials (e.g., SiC and $MoSi_2$) than does the hot zone. Accordingly, cold zone regions typically have only about ⅕ to 1/1000 of the resistivity of the hot-zone composition and do not rise in temperature to the levels of the hot zone. More preferred is where the cold zone(s) room temperature resistivity is from 5 to 20 percent of the room temperature resistivity of the hot zone.

A preferred cold zone composition for use in igniter of the invention comprises about 15 to 65 v/o aluminum oxide, aluminum nitride or other insulator material; and about 20 to 70 v/o $MoSi_2$ and SiC or other conductive and semiconductive material in a volume ratio of from about 1:1 to about 1:3. More preferably, the cold zone comprises about 15 to 50 v/o AlN and/or $Al_2O_3$, 15 to 30 v/o SiC and 30 to 70 v/o $MoSi_2$. For ease of manufacture, preferably the cold zone composition is formed of the same materials as the hot zone composition, with the relative amounts of semiconductive and conductive materials being greater.

The electrically insulating heat sink 16 should be comprised of a composition that provides sufficient thermal mass to mitigate convective cooling of the hot zone. Additionally, when disposed as an insert between two conductive legs as exemplified by the system shown in FIG. 1, the insert 16 provides mechanical support for the extended cold zone portions 14*a* and 14*b* and makes the igniter more rugged. In some embodiments, insert 16 may be provided with a slot to reduce the mass of the system. Preferably, the electrically insulating heat sink has a room temperature resistivity of at least about $10^4$ ohm-cm and a strength of at least about 150 MPa. More preferably, the heat sink material has a thermal conductivity which is not so high as to heat the entire heat sink and transfer heat to the leads, and not so low as to negate its beneficial heat sink function. Suitable ceramic compositions for the heat sink include compositions comprising at least about 90 vol % of at least one of aluminum nitride, boron nitride, silicon nitride, alumina and mixtures thereof. Where a hot zone composition of AlN—$MoSi_2$—SiC is employed, a heat sink material comprising at least 90 vol % aluminum nitride and up to 10 vol % alumina can be preferred for compatible thermal expansion and densification characteristics. A preferred heat sink composition is disclosed in co-pending U.S. patent application Ser. No. 09/217,793, the entire disclosure of which is incorporated herein by reference.

Ceramic igniters of the invention can be employed with a variety of voltages, including nominal voltages of 6, 8, 12, 24 and 120 volts. Igniters of the invention can heat rapidly from room temperature to operational temperatures, e.g. to about 1350° C. in about 4 seconds or less, even 3 seconds or less, or even 2.75 or 2.5 second or less.

Igniters of the invention also can provide a stable ignition temperature with a hot zone power density (surface loading) of from 60 to 200 watts per $cm^2$ of the hot zone region. Preferred power densities include from 70 to 180 watts per $cm^2$, more preferably from about 75 to 150 watts per $cm^2$.

The processing of the ceramic component (i.e., green body processing and sintering conditions) and the preparation of the igniter from the densified ceramic can be done by conventional methods. Typically, such methods are carried out in substantial accordance with the incorporated U.S. Pat. No. 5,786,565 to Willkens et al. and U.S. Pat. No. 5,191,508 to Axelson et al.

Preferably, igniters are produced in accordance with methods of the invention. These methods generally include simultaneous production of a plurality of igniters, e.g. at least 5 igniters, more typically at least 10 or 20 igniters, still more typically at least about 50, 60, 70, 80, 90 or 100 igniters, from a single sheet material (billet). More typically, up to about 100 or 200 igniters are suitably produced substantially simultaneously.

More specifically, in preferred igniter production methods of the invention a billet sheet is provided that comprises a plurality of affixed or physically attached "latent" igniter elements. The billet sheet has hot and cold zone compositions that are in a green state (not densified to greater than about 96% or 98% theoretical density), but preferably have been sintered to greater than about 40% or 50% theoretical density and suitably up to 90 ort 95% theoretical density, more preferably up to about 60 to 70% theoretical density. Such a partial densification is suitably achieved by a warm press treatment, e.g. less than 1500° C. such as 1300° C. for about 1 hour under pressure as 3000 psi and under argon atmosphere. It has been found that if the billet is the hot and cold zones compositions are densified at greater than 75 or 80 percent of theoretical density, the billet will be difficult to cut in subsequent processing steps. Additionally, if the hot and cold zones compositions are densified at less than about 50 percent, the compositions often degrade during subsequent processing. The hot zone portion extends across a portion of the thickness of the billet, with the balance being the cold zone.

The billet may be of a relatively wide variety of shapes and dimensions. Preferably, the billet suitably substantially square, e.g. a 9 inch by 9 inch square, or other suitable dimensions or shapes such as rectangular, etc. The billet is then preferably cut into portions such as with a diamond cutting tool. Preferably those portions have substantially equal dimensions. For instance, with a 9 inch by 9 inch billet, preferably the billet is cut into thirds , where each of the resulting sections is 9 inches by 3 inches.

The billet is then further cut (suitably with a diamond cutting tool) to provide individual igniters. A first cut will be through the billet, to provide physical separation of one igniter element from an adjacent element. Alternating cuts will not be through the length of the billet material, to enable insertion of the insulating zone (heat sink) into each igniter. Each of the cuts (both through cuts and non-through cuts) may be spaced e.g. by about 0.2 inches.

After insertion of the heat sink zone, the igniters then can be further densified, preferably to greater than 99% of theoretical density. Such further sintering is preferably conducted at high temperatures, e.g. at or slightly above 1800° C., under a hot isostatic press.

The several cuts made into the billet can be suitably accomplished in an automated process, where the billet is positioned and cut by a cutting tool by an automated system, e.g. under computer control.

Figure 2:
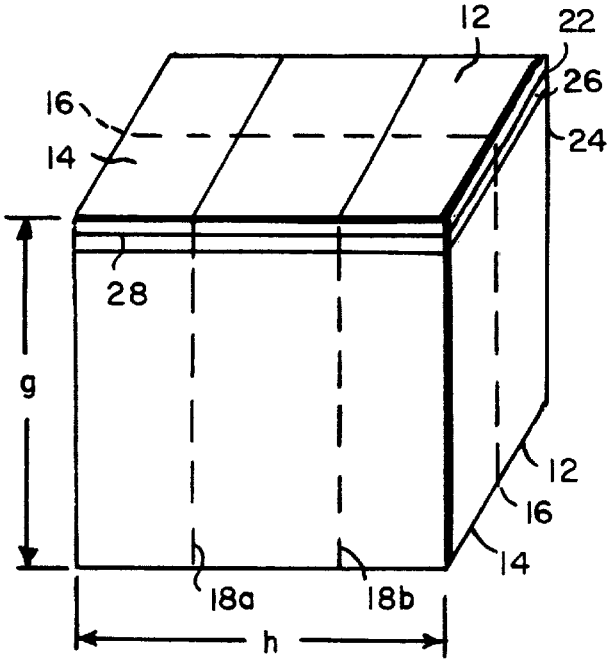
FIG. 2 depicts schematically an igniter production method of the invention.

FIG. 2 of the drawings shows a billet processed in accordance with the igniter manufacturing methods of the invention. As depicted, billet 10 has hot composition zone 12 and cold composition zone 14, with hot composition zone and cold composition zone interface 16. Preferably, at the manufacturing stage depicted in FIG. 2, the hot and cold zone compositions are in a green state, but preferably densified from about 40% to about 95% theoretical density, more preferably from about 50% to about 70% theoretical density.

Preferred billet 10 suitably has substantially equal dimensions, i.e. preferably dimensions g and h as shown in FIG. 2 are approximately equal, e.g. 9 inches by 9 inches as discussed above.

Billet 10 is then preferably cut into portions such as with a diamond cutting tool. Preferably those portions have substantially equal dimensions. For instance, as depicted in FIG. 2, preferably billet 10 is cut into thirds along lines 18*a* and 18*b*.

Billet 10 is then further cut (suitably with a diamond cutting tool) to provide individual, non-affixed igniter elements such as igniter 22. One cut will be full length through the billet (e.g. cut 24) and each alternating cut (e.g. cut 26) will not be through the length of the billet material, to enable insertion of the electrically insulating zone (heat sink) into each igniter such as through opening 28. Each cut 24 and 26 will be suitably spaced e.g. at 0.2 inches.

After insertion of the heat sink zone, the igniters can then be further densified, preferably to greater than 99% of theoretical density, as discussed above, preferably at about 1815° C. under a hot isostatic press.

The igniters of the present invention may be used in many applications, including gas phase fuel ignition applications such as furnaces and cooking appliances, baseboard heaters, boilers, and stove tops.

The following non-limiting examples are illustrative of the invention. All documents mentioned herein are incorporated herein by reference in their entirety.

EXAMPLE 1

Igniters of the invention were prepared and tested as follows.

Hot zone and cold zone compositions were prepared for a first igniter, referred to herein as Igniter A. The hot zone composition comprised 70.8 volume % (based on total hot zone composition) AlN, 20 volume % (based on total hot zone composition) SiC, and 9.2 volume % (based on total hot zone composition) $MoSi_2$. The cold zone composition comprised 20 volume % (based on total cold zone composition) AlN, 20 volume % (based on total cold zone composition) SiC, and 60 volume % (based on total cold zone composition) $MoSi_2$. The cold zone composition was loaded into a hot die press die and the hot zone composition loaded on top of the cold zone composition in the same die. The combination of compositions was densified together under heat and pressure to provide the Igniter A.

Hot zone and cold zone compositions were prepared for a second igniter, referred to herein as Igniter B. Igniter B had the same geometry and hot zone composition as Igniter A. The cold zone composition of Igniter B had the same components (AlN, SiC and $MoSi_2$) as Igniter A, but the Igniter B cold zone had a resistance that was approximately equivalent to the resistance of the Igniter B hot zone. As with Igniter A, the Igniter B cold zone composition was loaded into a hot die press die and the hot zone composition loaded on top of the cold zone composition in the same die. The combination of compositions was densified together under heat and pressure to provide the Igniter B.

Figure 3:
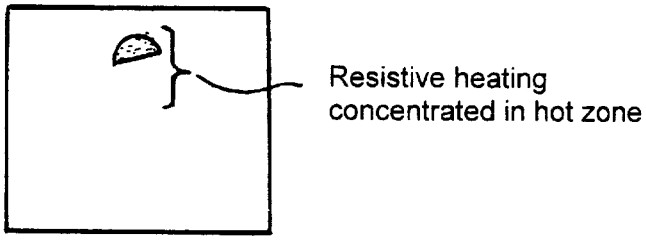
FIGS. 3 and 4 show results of Example 1, which follows.
Figure 4:
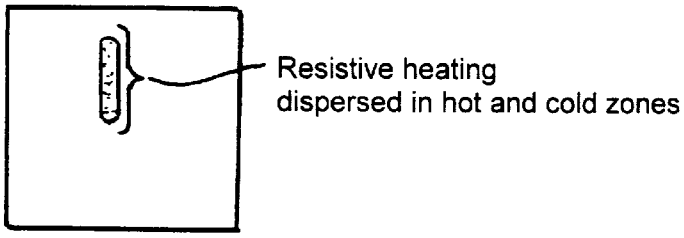

The formed Igniters A and B were energized at 12 volts. For Igniter A, resistive heating was focussed in the hot zone region of the igniter, as shown in the FIG. 3. For Igniter B, both the cold zone and hot zone regions of the igniter became hot, as shown in FIG. 4.

EXAMPLE 2

Seven additional igniters (designated as Samples 1 through 7 in the Table below) were prepared with the same hot zone and cold zone compositions as described for Igniter A in Example 1 above. The hot zone areas of each of Samples 1 through 7 was varied; those hot zone areas are expressed as $cm^2$ is shown in the Table below. The total resistance ("Total resist." below, expressed as Ω), hot zone resistance ("Hot zone resist." below, expressed as Ω), cold zone resistance ("Cold zone resist." below, expressed as Ω) were each measured and are set forth in the Table below.

TABLE

| Sample | Hot zone area | Total resist | Hot zone resist. | Cold zone resist. | $R_{hot}/R_{cold}$ |
|---|---|---|---|---|---|
| 1 | 1.10 | 36 | 12 | 11 | 1.09 |
| 2 | 1.06 | 33 | 12.9 | 9 | 1.43 |
| 3 | 8.71 | 28.3 | 11.4 | 8.1 | 1.41 |
| 4 | 7.84 | 37 | 14.1 | 10.5 | 1.34 |
| 5 | 7.35 | 42 | 17.5 | 11.3 | 1.55 |
| 6 | 5.90 | 45 | 19.9 | 11.6 | 1.72 |
| 7 | 5.81 | 40.2 | 22.6 | 7.7 | 2.94 |

These results showed that a minimum relative resistive the hot zone resistance ($R_{hot}$) to cold zone resistance ($R_{cold}$) of $R_{hot} \geqq 1.5(R_{cold})$ was optimal to achieve tip ting for the igniter samples.

The invention has been described in detail with reference to particular embodiments thereof. However, it will be appreciated that those skilled in the art, upon consideration of this disclosure, may make modifications and improvements within the spirit and scope of the invention.

What is claimed is:

1. A ceramic igniter element comprising:

a) a pair of electrically conductive portions, each portion having a first end; and b) a resistive hot zone disposed between and in electrical connection with each of the first ends of the electrically conducive portions, wherein the hot zone has an electrical path length of from 0.51 to 1.2 cm and electrically non-conductive heat sink material contacts the hot zone.

2. The igniter of claim 1 wherein the heat sink material is disposed between the conductive portions.

3. The igniter of claim 1 wherein each of the electrically conductive portions extend in the same direction from the hot zone to define a pair of legs, and the electrically non-conductive heat sink material is disposed between the legs.

4. The igniter of claim 1 wherein the hot zone has an electrical path length of at least 0.6 cm.

5. The igniter of claim 1 wherein the hot zone has an electrical path length of from 0.6 to 1.2 cm.

6. The igniter of claim 1 wherein the hot zone has an electrical path length of from 0.7 to 0.9 cm.

7. The igniter of claim 1 wherein the hot zone is non-linear.

8. The igniter of claim 1 wherein the hot zone is substantially U-shaped.

9. The igniter of claim 1 wherein the hot zone comprises a composition that comprises an electrically insulating material and a metallic conductor material.

10. The igniter of claim 9 further comprising a semiconductor material.

11. The igniter of claim 9 wherein the hot zone composition comprises:

(a) between 25 and 80 vol % of an electrically insulating material;

(b) between 3 and 45 vol % of a semiconductive material;

(c) between 5 and 25 vol % of a metallic conductor.

12. The igniter of claim 11 wherein the hot zone composition comprises $MoSi_2$ in an amount of from about 9.2 to 9.5 vol %.

13. The igniter of claim 1 wherein the room temperature resistivity of the electrically conductive portions is from about 5 to 20 percent of the room temperature resistivity of the hot zone.

14. The igniter of claim 1 wherein the ratio of the room temperature resistivity of the hot zone is at least about 1.5 times the room temperature resistivity of the cold zone portions.

15. The igniter of claim 1 wherein the hot zone has an electrical path length of from 0.7 to 1.2 cm.

16. The igniter of claim 1 wherein the hot zone has an electrical path length of from 0.8 to 1.2 cm.

17. The igniter of claim 1 wherein the hot zone has an electrical path length of from 0.7 to 1.2 cm.

18. The igniter of claim 1 wherein the hot zone has an electrical path length of from 0.8 to 1.2 cm.

19. A method of igniting gaseous fuel, comprising applying an electric current across an igniter of claim 1.

20. The method of claim 19 wherein the current has a nominal voltage of 6, 8, 12, 24 or 120 volts.

21. A ceramic igniter element comprising:

a) a pair of electrically conductive portions, each portion having a first end; and b) a resistive hot zone disposed between and in electrical connection with each of the first ends of the electrically conducive portions, wherein the hot zone produces a stable ignition temperature at a surface loading of from 60 to 200 watts per $cm^2$ and the hot zone has an electrical path length of from 0.51 to 1.2 cm.

22. The igniter of claim 21 wherein the hot zone has an electrical path length of from 0.6 to 1.2 cm.

23. A method of igniting gaseous fuel, comprising applying an electric current across an igniter of claim 21.

24. The method of claim 23 wherein power density in the hot zone is from 60 to 200 watts per $cm^2$.

25. The method of claim 23 wherein the current has a nominal voltage of 6, 8, 12, 24 or 120 volts.

26. A method for igniting gaseous fuel, comprising applying an electric current across an igniter of claim 21.

27. A ceramic igniter element comprising:

a) a pair of electrically conductive portions, each portion having a first end; and b) a resistive hot zone disposed between and in electrical connection with each of the first ends of the electrically conducive portions, wherein the hot zone has an electrical path length of from 0.51 to 0.9 cm.

28. The igniter of claim 27 wherein the hot zone has an electrical path length of from 0.6 to 0.9 cm.

29. The igniter of claim 27 wherein the hot zone has an electrical path length of from 0.7 to 0.9.

30. A ceramic igniter element comprising:

a) a pair of electrically conductive portions, each portion having a first end; and b) a resistive hot zone disposed between and in electrical connection with each of the first ends of the electrically conducive portions, wherein the hot zone has an electrical path length of from 0.51 to 1.2 cm, the hot zone comprising a composition that comprises: i) between 25 and 80 vol % of an electrically insulating material; ii) between 3 and 45 vol % of a semiconductive material; and iii) between 5 and 25 vol % of a metallic conductor.

31. The igniter of claim 30 wherein the hot zone has an electrical path length of from 0.6 to 1.2 cm.

32. The igniter of claim 30 wherein the hot zone has an electrical path length of from 0.7 to 0.9 cm.

33. A method for igniting gaseous fuel, comprising applying an electric current across an igniter of claim 30.

* * * * *